United States Patent [19]

Cogbill et al.

[11] Patent Number: 4,505,282

[45] Date of Patent: Mar. 19, 1985

[54] INNERLINER WRAP FOR SMOKING ARTICLES

[75] Inventors: Everett C. Cogbill; Robert S. Sprinkle, III, both of Hopewell, Va.

[73] Assignee: American Brands, Inc., New York, N.Y.

[21] Appl. No.: 493,287

[22] Filed: May 10, 1983

Related U.S. Application Data

[63] Continuation of Ser. No. 905,340, May 12, 1978, abandoned, which is a continuation of Ser. No. 720,359, Sep. 3, 1976, abandoned.

[51] Int. Cl.[3] ..... A24D 1/02; A24D 3/16

[52] U.S. Cl. ..... 131/334; 131/342; 131/358; 131/365

[58] Field of Search ..... 131/331, 332, 334, 335, 131/342, 343, 344, 358, 365

[56] References Cited

U.S. PATENT DOCUMENTS

| | | | |
|---|---|---|---|
| 7,001 | 1/1850 | Hoyt . | |
| 253,841 | 2/1882 | Carpenter . | |
| 261,034 | 7/1882 | Philips | 131/342 |
| 587,184 | 7/1887 | Cohen | 131/275 |
| 1,529,181 | 3/1925 | Holmes . | |
| 1,909,924 | 5/1933 | Schweitzer et al. . | |
| 2,114,281 | 4/1938 | Allen . | |
| 2,754,207 | 7/1956 | Schur et al. . | |
| 2,809,904 | 10/1957 | Koree . | |
| 2,915,069 | 12/1959 | Schur . | |
| 2,944,553 | 7/1969 | Storch . | |
| 3,007,917 | 11/1961 | Pauling . | |
| 3,106,210 | 10/1963 | Reynolds et al. . | |
| 3,145,717 | 8/1964 | Osborne et al. . | |
| 3,364,200 | 1/1968 | Ashton et al. . | |
| 3,395,714 | 8/1968 | Kahane . | |
| 3,608,560 | 9/1971 | Briskin et al. . | |
| 3,633,589 | 1/1972 | Kahane et al. . | |
| 3,744,496 | 7/1973 | McCarty et al. | 131/365 |

FOREIGN PATENT DOCUMENTS

| | | |
|---|---|---|
| 702918 | 2/1965 | Canada . |

OTHER PUBLICATIONS

Leffingwell et al., "Tobacco Flavoring for Smoking Products", Reynolds Tobacco, p. 63, 1972.

"The Manufacture of Paper", Davis, p. 581, published by Baird & Co., Philadelphia, 1886.

*Primary Examiner*—V. Millin

*Attorney, Agent, or Firm*—Pennie & Edmonds

[57] ABSTRACT

This invention relates to an innerliner wrap for a tobacco smoking article comprising a combustible porous sheet of cellulosic fibers and finely pulverized porous carbon particles coated with calcium citrate, and a smoking article comprising a tobacco filler, an innerliner wrap encasing said filler, and an outer wrap over said innerliner wrap, said innerliner wrap comprising a combustible porous sheet of cellulosic fibers and finely pulverized porous carbon particles coated with calcium citrate.

13 Claims, No Drawings

INNERLINER WRAP FOR SMOKING ARTICLES

REFERENCE TO RELATED APPLICATIONS

This application is a continuation of application Ser. No. 905,340, filed May 12, 1978, now abandoned, which, in turn, was a continuation of application Ser. No. 720,359, filed Sept. 3, 1976, which application has now become abandoned.

BACKGROUND OF THE INVENTION

U.S. Pat. No. 3,744,496 describes the use of a carbon-filler innerliner wrapper for smoking articles. More particularly, there is described the use of a carbon-filled cellulosic sheet to reduce total particulate matter yield and organic vapor phase constituents in the mainstream smoke from a smoking article while, at the same time, reducing the visible sidestream smoke.

While generally satisfactory, it has been found, however, that such liners are not entirely satisfactory and have several defects. First, smoking articles containing such innerliners have a very disagreeable sidestream odor. Secondly, the mainstream smoke is deficient in taste. Thirdly, such smoking articles burn with an unattractive flakey ash. Lastly, it has been difficult to control the burning rate of the innerliner. It tends to burn at a rate different from that of conventional smoking article wrapper paper and, because of the use of carbon, the burning tends to undesirably affect the flavor of the smoking article. In some cases, the presence of the carbon also results in sparks upon combustion rendering the resultant smoking article undesirable. There has also been the color problem in that, with innerliners containing high amounts of carbon, they appear nearly black in color, consequently making them visually unsuitable for many smoking products, such as cigarettes, despite the placement thereover of a conventional smoking article wrapper.

Efforts to overcome these problems by the utilization of certain chemicals to control the burning characteristics of the innerliner have not been successful. Included are the materials, such as citrates, phosphates, and nitrate salts, as mentioned in U.S. Pat. No. 3,744,496. The use of such chemicals admixed with the carbon-filled innerliner does not, however, result in any significant improvement in the bitterness, odor, etc., of the smoke or the flaring characteristics of the carbon. The use of flavoring additives has also been unsuccessful.

SUMMARY OF THE INVENTION

It has now been found that the disagreeable sidestream odor, the deficiencies in taste in the mainstream smoke, and the unattractive flakey ash can be overcome while, at the same time, retaining the positive features of a carbon-filled innerliner.

Briefly stated, the present invention comprises an innerliner wrap for a tobacco smoking article comprising a combustible porous paper sheet of cellulosic fibers and finely pulverized activated carbon particles coated with calcium citrate, and a smoking article comprising a tobacco filler with said innerliner encasing said filler and an outer wrap over said innerliner wrap.

DETAILED DESCRIPTION

The innerliner wrap comprises a combustible porous sheet of cellulosic fibers and finely pulverized porous carbon particles coated with calcium citrate.

The particular cellulosic fiber used may be any conventionally used for this purpose as described in U.S. Pat. No. 3,744,496. In addition, and as described in this patent, the wrap can be formed on conventional paper making machines.

In accordance with the present invention, it is critical that calcium citrate be precipitated onto the carbon to coat the same before the carbon is incorporated into the innerliner wrap and that preferably St. John's Bread be used to flavor the sheet.

The carbon used may be any of the finely pulverized activated carbons customarily used for this purpose, but it is much preferred to use pulverized, activated, coal based carbon having an iodine number of less than about 650 (preferably 550 to 650) and a carbon tetrachloride activity of no more than about 30 (preferably 15 to 30). A specific example is Pittsburgh HTD carbon manufactured by Pittsburgh Activated Carbon Company (Calgon Corp.).

Before the carbon is admixed with the cellulosic fiber to form the wrap, it must be coated with calcium citrate.

With respect to the calcium citrate, this is preferably applied to the carbon by forming a slurry of the carbon in a water solution of calcium acetate and adding thereto a water solution of potassium citrate. Stirring of the aqueous slurry is continued for a time sufficient to form the calcium citrate which is precipitated onto the surface of the carbon. The slurry of the coated carbon is then added to the cellulose fibers to form the stock for making the wrap. Recognizing the slight solubility of calcium citrate in water, the coated carbon is admixed with the cellulose fibers just prior to formation of the sheet on a paper making machine or other conventional sheet making equipment.

St. John's Bread is the preferred flavoring and is also added to the material used to form the sheet at any point, although preferably it is added to the slurry of calcium acetate and carbon together with the potassium citrate. Other flavoring materials that can be used are: licorice, glycyrrhizin, ammonium glycyrrhizinate, Clary Sage Oil or Absolute, sclereolide, lupulin, vanillin, menthol, nicotine, and tobacco extracts, but these are not as suitable as the St. John's Bread.

As to proportions, the proportions of calcium citrate used can vary widely. It has been found, for example, that most satisfactory results are obtained if, for each part by weight of carbon there is used about 0.6 to 1 part by weight of calcium citrate. With respect to the flavoring for each 100 parts by weight of innerliner wrap there should be used about 2 parts by weight of St. John's Bread. The amount of coated carbon used can vary from about 5 to 80 parts by weight for each 100 parts by weight of the wrap and, preferably, from about 60 to 70 parts by weight.

After the innerliner wrap is formed, it is applied to a smoking article in the same manner as conventional wraps. In the case of cigarettes, after the innerliner wrap is applied around the tobacco filler material a conventional cigarette wrap is placed thereover. With cigars, the innerliner is placed around the tobacco filler and a conventional cigar wrap used as the outer covering.

As used herein, the term "tobacco filler" is intended to include all the usual materials such as tobacco leaf, shredded tobacco lamina, shredded reconstituted tobacco, tobacco shreds, mixtures thereof, and the like, together with the usual additives, such as flavorings and the like, conventionally used in making cigarettes and cigars.

The invention will be further described in connection with the following examples which are set forth for purposes of illustration only and in which proportions are in percent by weight unless expressly stated to the contrary.

EXAMPLE 1

Thirty-six grams of calcium acetate, $Ca(C_2H_3O_2)_2 \cdot H_2O$, were dissolved in 180 ml. of hot water and 36 g. of Pittsburgh HTD carbon were added while stirring with a magnetic stirrer. Forty-five grams of potassium citrate, $K_3C_6H_5O_7.H_2O$, were dissolved in 80 ml. hot water and 2.1 g. St. John's Bread slurried into the solution. The mixture of potassium citrate and St. John's Bread was then added to the suspension of carbon in calcium acetate solution, and the resulting mixture stirred for one hour. The carbon and precipitated calcium citrate was filtered on a Buchner funnel, rinsed with about 200 ml. water and dried overnight in an oven. The yield of product was 68.7 g., with a calculated carbon content of 52.4%. Handsheets were made using this material as filler. The sheet weight was 90 g/m$^2$ with filler content of 67% and 33% paper pulp.

EXAMPLE 2

Four hundred pounds of HTD carbon were added to a solution of 400 pounds of calcium acetate dissolved in cold water. Five hundred pounds of potassium citrate were dissolved in cold water and added to the charcoal-/acetate slurry. The mixture was diluted to a pumpable consistency and agitated for one hour to complete the reaction. The coated carbon slurry was mixed with a slurry of bleached fiber pulp (consisting of 41.5% Albacel, 41.5% Solka-20 and 17% Astracel bleached fibers) and formed into a sheet on a paper making machine.

The final innerliner wrap had the following typical analysis:

Moisture, %: 6.6
Carbon, % (dry basis): 43.5
Calcium Citrate.$4H_2O$, % (dry basis): 33.0
Total Filler, % (dry basis): 76.5
Seet Weight, g/m$^2$: 77

Cigarettes made with this innerliner wrap showed a 64% reduction of particulate matter and a 40% reduction of nicotine in the sidestream smoke when compared to control cigarettes without the innerliner.

EXAMPLE 3

Five hundred pounds of calcium acetate was dissolved in 250 gal. water and 500 pounds Pittsburgh HTD carbon added and agitated 30 minutes. Six hundred-twenty-five pounds potassium citrate was dissolved in 50 gal. water. This solution was then pumped into the tank containing the carbon/calcium acetate slurry. The mixture was diluted to a total volume of 550 gal. and allowed to react for one hour. The filler was metered into a suspension of fiber pulp and formed into a sheet on a paper making machine. The fiber mixture was composed of 41.5% Albacel, 41.5% Solka-20, and 17% Astracel bleached fibers.

The final innerwrap had the following typical analysis:

Moisture, %: 6.4
Carbon, % (dry basis): 39.4
Calcium Citrate, % (dry basis): 28.5
Total Filler, % (dry basis): 67.9
Sheet Weight, g/m$^2$: 75.5

Cigarettes made with this innerliner wrap showed a 54% reduction of sidestream particulate and 36% reduction of nicotine in the sidestream smoke when compared to a control cigarette without the innerliner.

EXAMPLE 4

An innerliner wrap was prepared using 282 pounds of bleached fiber (141 pounds of softwood bleached fiber and 141 pounds of Solka 20 bleached fiber) and 600 pounds of calcium citrate coated carbon.

The coated carbon was first prepared by dissolving 300 pounds of calcium acetate in 150 gallons of water in a suitable sized tank. Three hundred pounds of Pittsburgh HTD carbon was added to the solution and the resultant slurry agitated for 30 minutes. Three hundred seventy pounds of potassium citrate was dissolved in 50 gallons of water in a second suitably sized tank. Eighteen pounds of St. John's Bread was added to the solution prior to pumping into the tank containing the carbon. The resultant mixture was diluted to a total volume of 280 gallons and allowed to react for one hour with continuous stirring.

The coated carbon slurry was mixed with the fiber and formed into a sheet on a paper making machine.

The final innerliner wrap had the following typical analysis:

Moisture, %: 6.7
Carbon, % (dry basis): 39.6
Calcium Citrate.$4H_2O$, % dry basis: 27.6
Total Filler, % (dry basis): 67.2
Sheet Weight, g/m$^2$: 87
Tensile Strength, g: 1,561
Stretch, %: 1.6
Porosity (sec/300 ml): 64

EXAMPLE 5

In order to prepare a brown colored innerliner similar in shade to the commonly used natural or reconstituted cigar binders, a mixture of water-soluble dyes was formulated. This mixture was composed of 4.66 g. of F.D.&C. Yellow No. 5, 4.66 g. of F.D.&C. Red No. 40, and 0.68 g. of F.D.&C. Blue No. 1. This mix was dissolved in one liter of water to give a solution of 1% total dye content. Five hundred milliliters of this solution was diluted to one liter to give a solution of 0.5% total dye content. Strips of innerliner prepared according to Example 4 (which has a grey color) were dipped in these solutions and pressed out between rollers. The amount of solution picked up by the sheet was about twice the sheet weight. When dired, the innerliner samples had brown shades suitably matching ordinary cigar binders and are used as innerliners in the manufacture of cigars.

While the invention has been described in connection with the preferred embodiments, it is not intended to limit the invention to the particular forms set forth, but, on the contrary, it is intended to cover such alternatives, modifications, and equivalents as may be included within the spirit and scope of the invention as defined by the appended claims.

What is claimed is:

1. An innerliner wrap for a tobacco smoking article comprising a combustible porous paper sheet of cellulosic fibers and finely pulverized activated carbon particles combined intimately with a precipitate of calcium citrate, said carbon particles having a porous surface whereby said calcium citrate is located into and onto said carbon particles to coat both the inner and outer surface.

2. The innerliner wrap of claim 1 wherein the coated carbon particles comprises at least 5% by weight of the wrap.

3. The innerliner wrap of claim 1 including St. John's Bread in an amount sufficient to flavor.

4. The innerliner wrap of claim 1 including St. John's Bread in an amount of about 2% by weight of the wrap and wherein the coated carbon particles comprises from about 5 to 80% by weight of the wrap.

5. The innerliner wrap of claim 1 wherein for every part by weight of carbon particles there is from about 0.6 to 1 part by weight of calcium citrate.

6. A smoking article comprising a tobacco filler, an innerliner wrap encasing said filler, and an outer wrap over said innerliner wrap, said innerliner wrap comprising a combustible porous paper sheet of cellulosic fibers and finely pulverized activated carbon particles combined intimately with a precipitate of calcium citrate, said carbon particles having a porous surface whereby said calcium citrate is located into and onto said carbon particles to coat both the inner and outer surfaces.

7. The smoking article of claim 6 wherein the coated carbon comprises at least 5% by weight of the innerliner wrap.

8. The smoking article of claim 6 wherein the innerliner wrap includes St. John's Bread in an amount sufficient to flavor.

9. The smoking article of claim 6 wherein the innerliner wrap includes St. John's Bread in an amount of about 2% by weight and the coated carbon particles comprises from about 5 to 80% by weight of the wrap.

10. The smoking article of claim 6 wherein for every part by weight of carbon particles there is from about 0.6 to 1 part by weight of calcium citrate.

11. The method for forming a porous paper sheet for use as a combustible innerliner wrap for a tobacco smoking article comprising suspending carbon in the form of finely pulverized, activated particles particles in a solution including a calcium salt, providing a solution including a citrate salt, mixing and stirring said suspension and solution whereby calcium citrate precipitates into and onto said carbon particles to coat both the inner and outer surfaces, mixing said coated carbon in a slurry of cellulosic fiber, and forming said porous paper sheet.

12. An innerliner wrap for a tobacco smoking article formed by the method of claim 11.

13. A smoking article comprising a tobacco filler, an innerliner wrap formed by the method of claim 11 encasing said filler, and an outer wrap over said innerliner wrap.

* * * * *

UNITED STATES PATENT AND TRADEMARK OFFICE

CERTIFICATE OF CORRECTION

PATENT NO. : 4,505,282

DATED : March 19, 1985

INVENTOR(S) : Everett C. Cogbill
Robert S. Sprinkle, III

It is certified that error appears in the above-identified patent and that said Letters Patent is hereby corrected as shown below:

Column 3, line 44, "Seet" should be --Sheet--.

Column 4, line 51, "dired" should be --dried--.

Signed and Sealed this

*Thirteenth* Day of *August 1985*

[SEAL]

*Attest:*

DONALD J. QUIGG

*Attesting Officer* *Acting Commissioner of Patents and Trademarks*